United States Patent [19]

Hammer

[11] 3,968,658

[45] July 13, 1976

[54] METHOD AND APPARATUS FOR INTRODUCING WATER-PROOF SHEETING INTO THE GROUND IN A VERTICAL POSITION

[75] Inventor: Heiner I. Hammer, Klecken, Germany

[73] Assignee: Schlegel Engineering GmbH, Hamburg, Germany

[22] Filed: Sept. 4, 1974

[21] Appl. No.: 502,953

[30] Foreign Application Priority Data

Sept. 12, 1973 Germany ..... 2345983

[52] U.S. Cl. ..... 61/72.1; 61/35

[51] Int. Cl.[2] ..... E02F 5/22

[58] Field of Search ..... 61/72.1, 72.6, 35, 72.7

[56] References Cited

UNITED STATES PATENTS

| | | | |
|---|---|---|---|
| 1,787,902 | 1/1931 | Herfort | 61/72.6 |
| 3,298,183 | 1/1967 | Grether et al. | 61/72.1 |
| 3,309,875 | 3/1967 | Niederwemmer | 61/72.6 |
| 3,313,115 | 4/1967 | Kniefel | 61/72.6 |
| 3,564,855 | 2/1971 | Mörner | 61/35 |
| 3,590,588 | 7/1971 | Draper | 61/72.6 |
| 3,603,099 | 9/1971 | Zakiewitz | 61/72.1 |
| 3,618,329 | 11/1971 | Hanson | 61/72.6 |
| 3,759,044 | 9/1973 | Caron | 61/35 |

*Primary Examiner*—Jacob Shapiro
*Attorney, Agent, or Firm*—Bierman & Bierman

[57] ABSTRACT

Method and apparatus for placing a horizontally elongated flexible material in vertical position in a trench are provided in which a portion of the trench is cut and the material placed therein. The open trench is then filled and the next section of the trench is cut and material placed therein. The process is separated until the desired length of the trench has been cut and the material has been placed therein. A cassette is provided which contains the material. The cassette has a slot to permit the material to pay-out as each section of trench is cut.

6 Claims, 4 Drawing Figures

Figures 1, 2, 3, 4:
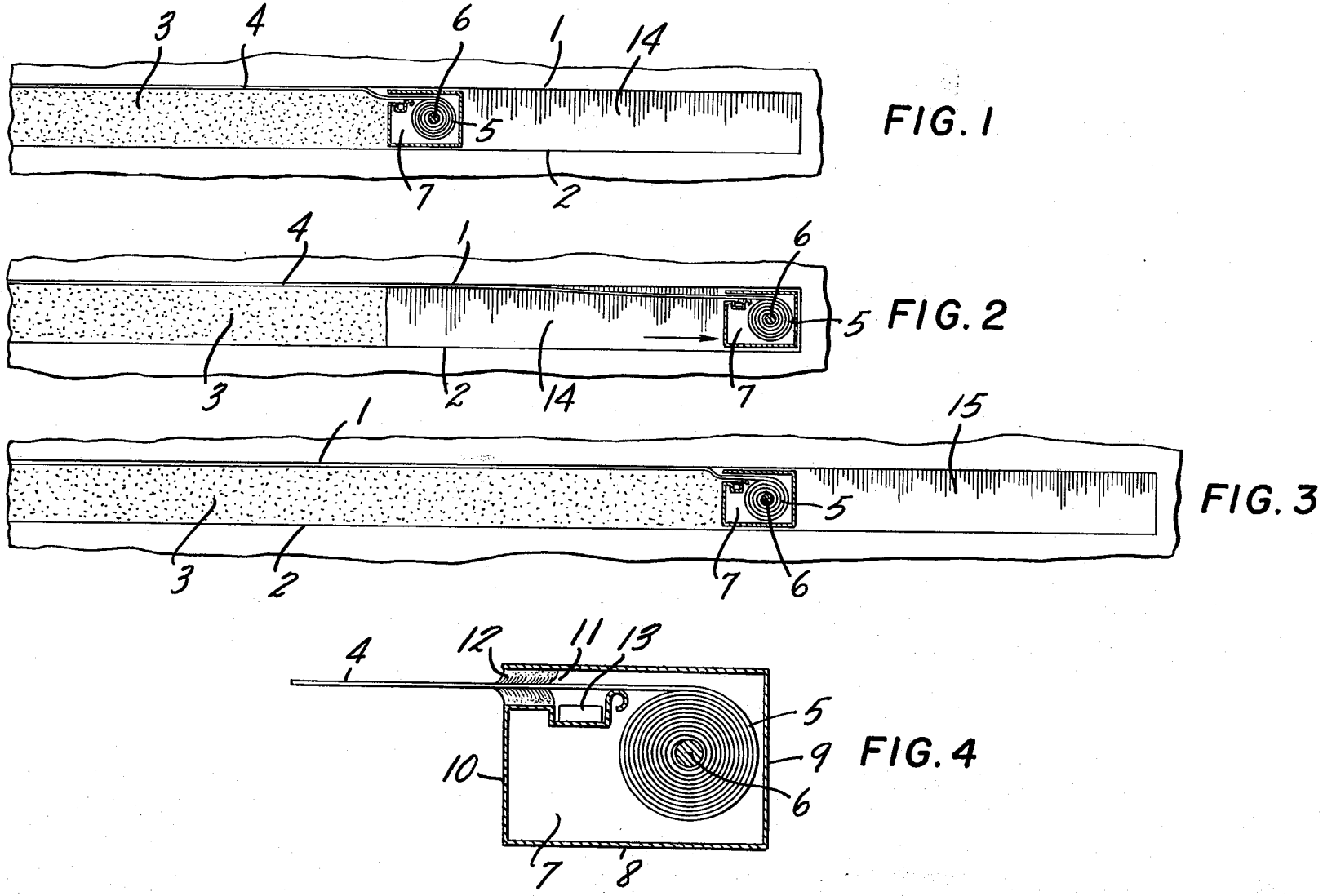

METHOD AND APPARATUS FOR INTRODUCING WATER-PROOF SHEETING INTO THE GROUND IN A VERTICAL POSITION

This invention relates to a method of and an apparatus for introducing a horizontally elongate flexible material, more particularly a water-proof sheet, in a vertical position into a trench which trench is filled in after the sheet material has been placed therein.

It is well known to introduce plastic sheeting into the soil for water-proofing purposes. Previously, this has been done by placing the sheeting into the ground in either a horizontal or slightly inclined position. The sheet is introduced into the ground, the top soil first having been cleared away, the sheeting is laid out and the soil is then filled in. Vertical waterproof sheeting was hitherto not used, because it was found too difficult to introduce into the soil. This applies particularly to waterproof courses of a height of several meters, which could hitherto be made more cheaply by excavating a trench of a corresponding depth and filling it with concrete. However, the costs of this are very high. Concrete also has the disadvantage of only limited resistance to humic acids and insufficient resilience to subsidence. With concrete, leaks are inevitable owing to cracking. In contradistinction thereto, plastic sheeting has the advantage of high chemical resistance and resilience to ground movement and is also cheaper. Plastic sheeting is not only cheaper in comparison with concrete itself, but it is also cheaper to transport. When concrete is used, not only the concrete, but the excavated soil must be transported away from the site. When plastic sheeting is used, the soil can be re-used for filling in the trench.

A principal object of the invention is to provide a method and apparatus of the above kind whereby waterproof courses of a considerable height (several meters) can be introduced into the ground in a simple manner.

To this end, according to the invention, the introduction of the sheeting and the filling in of the trench are effected either continuously or substantially simultaneously on a step-by-step basis, a short section of the sheet material being retained at its rear side (as considered in the direction of advance) by a filled-in trench section.

Since only a small section of the sheet material is required to be held by this method at any one time, and this small section is clamped by the filled-in trench zone on one side, relatively small forces are sufficient to secure the sheet material in this section in the required position. This permits the retaining device acting on the free end of the section to be made relatively simply. This retaining device may therefore comprise a pay-out device which, for example, is a holder for a roll or zig-zag stack of the sheet material which is to be laid.

According to the invention, the holder may be provided with a protective wall which faces forwardly with reference to the direction of advance. This construction allows a very advantageous method in which the trench is excavated in short sections. When one such section has been excavated and the sheet together with the holder or pay-out device has been lowered therein and laid out, the next section can be excavated along the holder protective wall. The protective wall ensures that the supply of sheet material will not be damaged by the earthworking tools, although the next section immediately adjoins the previously excavated sections. At the same time, during the excavation of the next subsequent trench section, the previously excavated section provided with the laid-out sheet can be filled in, advantageously using the soil from the next trench section.

To ensure that the supply of sheet material is not damaged during filling in of the trench section, the holder for said supply is advantageously also provided with a corresponding protective wall at the rear side. This is best embodied by giving the holder the form of a cassette which accommodates the supply of sheet and which is closed on all sides except for a rear slot for paying out the sheeting. The slot is advantageously situated off-center and over to one side of the trench as far as possible. This gives sufficient room for filling-in between the laid-out sheet material and the other side of the trench. The cassette thus forms a barrier between an excavated trench section provided with the sheet and the next section for excavation but without making it difficult for the sections to adjoin one another during the insertion process. The fact that the two trench sections adjoin one another also enables the cassette to be advanced with suitable advancing means (for example hydraulically or suspended from a crane), as soon as the next trench section has been excavated and the preceding one filled in.

The length of the individual sections is advantageously less than or equal to the length over which the sheet material can be held in the required position without any appreciable tension. In the case of polyethylene sheeting 2 – 3 mm thick and 5 meters wide (laying height), the said lengths are, for example, 2 – 4 meters.

The result is a very simple laying method in which only two laying sections are in operation at any time even if the total laying length is considerable, the two laying sections being the trench section for excavation and the trench section for filling in, the soil of one simply being thrown into the other. As soon as a section has been excavated, the cassette containing the supply of sheeting is advanced, whereupon the excavation of the next section and filling in of the section just provided with the sheeting can be started. The only tools required are a suitable excavator, for example a diaphragm wall grab excavator, and a retaining and advancing device for the cassette. This device may, for example, be an ordinary motor vehicle provided with hydraulic manipulating devices for the cassette.

If the sheet material is to be laid in webs which are to be joined in seal-tight relationship, the holder for the supply of sheet material or the cassette is advantageously provided with a welding or bonding device. For example, a guide for a vertically movable welding carriage may be disposed inside the cassette near the sheet material exit slot. After the supply of sheet material has been changed, the end of one web is still situated in this zone as is the start of the next web, so that a substantially automated connection between the two pieces can be carried out very simply. To ensure that this zone remains clean, the slot provided for the exit of the sheet material from the cassette is advantageously provided with suitable sealing means, for example a plurality of consecutive outwardly extending lip seals which bear against the paid-out sheet material and, if required, transmit by their friction any required tension to the material for paying out.

It is primarily intended that the cassette for the supply of sheet material will remain constantly in the trench and that a new supply, for example a new roll of sheet material, will simply be inserted into the cassette from above once one supply has been used up. However, it is of course possible to change the entire cassette. This applies particularly if the welding device is not organically connected to the cassette.

The method according to the invention, wherein all that is required is to open up short sections of the laying trench, without workers having to climb down into the trench, renders any shoring up of the sides of the trench unnecessary in the case of stable soils. However, the method according to the invention is also suitable for unstable soils, particularly when a protective liquid is used. Within the context of the invention this term covers all liquids which, when used as a filling for the trench sections, prevent the same from collapsing or the walls from slipping. These are particularly thixotropic suspensions in water, for example suspensions of bentonite in water.

A considerable saving of protective liquid is obtained according to the invention by the following procedure: After the sheet material has been laid in one trench section, the next trench section is excavated so as to communicate with the first trench section while at the same time the first trench section is filled in (advantageously with the soil removed from the second section). The protective liquid displaced from the first trench section flows in these circumstances over into the second section. In this case the cassette must of course be so constructed as to leave free sufficient overflow space between itself and the walls of the trench. This method has three advantages: firstly, an extremely small quantity of protective liquid is required, i.e., only slightly more in volume than one trench section can accommodate. Secondly, only a little of the protective liquid is lost, because it can flow off conveniently into the next trench section during the filling-in operation. Thirdly, the filling of the new trench section is effected automatically without any apparatus being required for pumping the liquid.

One exemplified embodiment of the invention will be explained in detail hereinafter with reference to the drawing, wherein FIGS. 1 – 3 illustrate consecutive stages of the method and are top views of the trench; and FIG. 4 is a diagrammatic cross-section of a cassette.

The two lines 1, 2 denote the limits of a trench, which has been filled in to a selected degree indicated by the stypling in the drawings, while the non-stypled part is open. A water-proof sheeting 4 has been disposed in the filled-in zone 3 and in the example illustrated is a 2.7 mm thick polyethylene sheeting. It is well known that this material is resistant to the action of moisture and the chemical influences of the soil. It also has high flexibility and is very tough so that it can withstand the forces occurring during laying and filling-in of the trench, and changes of position of the soil.

The sheeting which is to be laid in position is wound in the form of a roll (FIG. 4) on a core 6 in a cassette 7, which may be regarded as similar to a film cassette. It comprises a stable steel casing 8 provided with retaining means (not shown) for securing to a device (not shown) for carrying and advancing the cassette. It is closed at the forward side 9 as considered in the direction of advance (arrow in FIG. 2), at the side surfaces, at the back 10, and at the bottom. The top (not shown in the drawing) is open but closable by means of a lid (not shown). The cassette is provided with bearing means for the core 6 at top and bottom. At the back, the cassette is provided with a slot 11 tangentially of the roll 5 for paying out the sheeting 4, said slot being provided with lip seals 12 to prevent the penetration of dirt and protective liquid from the trench into the interior of the cassette. Reference 13 denotes a welding device which is vertically displaceable over the entire height of the cassette and is adapted to weld two ends of the sheeting situated in its vicinity.

FIG. 4 is a simple diagrammatic view of the arrangement of the individual elements of the cassette in relation to one another.

The cassette is secured through the agency of hydraulic manipulating devices on a stable off-the-highway vehicle, for example a lorry or a caterpillar vehicle. The manipulating devices are so constructed that they ensure a correct position of the cassette inside the trench and can effect its advance even when the vehicle position varies.

The trench is excavated by a conventional diaphragm wall grab excavator in a width of from 40 to 60 cm and a section length of 2.75 meters. Suitable diaphragm wall grab excavators are known. They are capable of effecting a substantially prismatic excavation of the said cross-section.

In the stage of the process shown in FIG. 1, part of the sheeting has been embedded and retained in the filled-in zone 3 of the trench 1, 2. The diaphragm wall grab excavator has excavated a section 14 in front of the cassette 7 as considered in the direction of advance. Referring to FIG. 2, the cassette 7 is advanced as far as possible in the direction of the arrow in this section. In these circumstances the sheeting unwinds in a corresponding length and is then retained between the zone 3 and the cassette 7 inside the zone 14. The length of the section is such that the sheeting retains the required position by its own stiffness without any appreciable longitudinal tension.

When the cassette 7 has reached the position shown in FIG. 2, the excavator starts the excavation of the next trench section 15 shown in FIG. 3 and fills in the excavation in the previously opened section 14 in which the sheeting was laid out. After complete excavation of the section 15 the situation shown in FIG. 3 is similar to the situation shown in FIG. 1 but is advanced by the length of one section.

As soon as the roll 5 has been used up — after about 90 meters in the case of a core diameter of 10 cm and an outside roll diameter of about 50 cm — the cassette is advanced only to an extent such that the end of the sheeting used is in the zone of the welding device 13. The empty core 6 is then removed and replaced by a full core, the beginning of the sheeting also being in the zone of the welding device 13, which can then join the adjacent sheeting ends.

The method according to the invention is suitable for theoretically unlimited sheeting widths and laying heights, for example 5 or 10 meters, and has considerable advantages even in the case of small laying heights, for example more than 1.5 meters.

Modifications of the above-described embodiment will occur to those skilled in the art. It is intended to cover all such modifications which do not constitute departures from the spirit and scope of the invention as defined in the claims appended hereto.

What is claimed is:

1. A method of introducing a horizontally elongated flexible sheet material, more particularly a waterproofing sheeting, in a vertical position into a trench by sequentially excavating a plurality of trench sections of short length in comparison to the length of the sheet material to be used, comprising the steps of excavating a first trench section introducing a protective liquid into the first of said trenches, introducing said sheet material along with a pay out device for said sheet material into said first trench section such that the pay out device is adjacent the next subsequent trench section to be excavated and a portion of said sheet material is vertically adjacent one wall of said trench, excavating the next trench section and placing the material excavated from the next trench into said first trench section as the excavated material is removed from the next trench section, allowing the protective liquid to be displaced from the first trench section into the next trench section as the said first trench section is filled with excavated material from the next trench section, and paying out sheet material into the next trench section.

2. The method according to claim 1 further comprising the step of excavating at least one additional section of trench, placing sheet material in said additional section of trench and filling said additional section of trench.

3. The method according to claim 1 wherein said sheet material and said excavated material are introduced into said trench simultaneously.

4. A method according to claim 1, further comprising the step of providing a protective wall between said pay-out device for said sheet material and the trench section for excavation during excavation of said trench section.

5. The method according to claim 1 wherein said pay out device is smaller in width than the width of the trench to permit the displacement of protective liquid from the said first trench section to the next trench section around the sides of the pay out device.

6. The method according to claim 1 wherein the protective liquid is a thixotropic suspension in water.

* * * * *